US009976708B2

(12) United States Patent
Sobczyk et al.

(10) Patent No.: US 9,976,708 B2
(45) Date of Patent: May 22, 2018

(54) LIGHTING MEANS HAVING A SPECIFIABLE EMISSION CHARACTERISTIC AND PRODUCTION METHOD FOR AN OPTICAL ELEMENT

(71) Applicant: OSRAM Opto Semiconductors GmbH, Regensburg (DE)

(72) Inventors: Sandra Sobczyk, Regensburg (DE); Frank Singer, Regenstauf (DE); Wolfgang Moench, Pentling (DE); Matthias Sabathil, Regensburg (DE)

(73) Assignee: OSRAM Opto Semiconductors GmbH, Regensburg (DE)

( * ) Notice: Subject to any disclaimer, the term of this patent is extended or adjusted under 35 U.S.C. 154(b) by 0 days. days.

(21) Appl. No.: 15/113,017

(22) PCT Filed: Jan. 16, 2015

(86) PCT No.: PCT/EP2015/050783
§ 371 (c)(1),
(2) Date: Jul. 20, 2016

(87) PCT Pub. No.: WO2015/107153
PCT Pub. Date: Jul. 23, 2015

(65) Prior Publication Data

US 2017/0002988 A1 Jan. 5, 2017

(30) Foreign Application Priority Data

Jan. 20, 2014 (DE) ..... 10 2014 100 582

(51) Int. Cl.
*F21V 9/16* (2006.01)
*F21K 9/64* (2016.01)
(Continued)

(52) U.S. Cl.
CPC ..... *F21K 9/64* (2016.08); *F21K 9/61* (2016.08); *F21V 3/02* (2013.01); *F21V 5/043* (2013.01);
(Continued)

(58) Field of Classification Search
CPC ..... F21K 9/64; F21K 9/61; F21K 9/90; F21V 3/02; F21V 5/043; F21V 3/0436;
(Continued)

(56) References Cited

U.S. PATENT DOCUMENTS

2005/0111236 A1* 5/2005 Hulse ..... G02B 6/001 362/84
2007/0058359 A1 3/2007 Saitoh et al.
(Continued)

FOREIGN PATENT DOCUMENTS

CN 1955814 A 5/2007
CN 102303946 A 1/2012
(Continued)

*Primary Examiner* — Y M. Lee
(74) *Attorney, Agent, or Firm* — McDermott Will & Emery LLP

(57) ABSTRACT

The invention relates to a lighting means (1), comprising: an optical element (3), which has a main extension direction (Z), a radiation inlet surface (3*a*), and a radiation outlet surface (3*b*); and at least two light-emitting diodes (2), which each comprise at least one light-emitting diode chip (21) and a radiation passage surface (2*a*), which extends along a main extension plane (XZ); wherein the at least two lighting-emitting diodes (2) are arranged along the main extension direction (Z) of the optical element (3), the radiation inlet surface (3*a*) of the optical element (3) faces the radiation passage surfaces (2*a*) of the at least two light-emitting diodes (2), the optical element (3) is formed as a solid body, the radiation inlet surface (3*a*) of the optical element (3) is flat or convexly curved, and the radiation
(Continued)

outlet surface (3*b*) of the optical element (3) comprises at least one recess (4) in the optical element (3).

18 Claims, 5 Drawing Sheets

(51) Int. Cl.

| | |
|---|---|
| ***F21V 5/04*** | (2006.01) |
| ***F21K 9/61*** | (2016.01) |
| ***F21V 3/02*** | (2006.01) |
| *F21K 9/90* | (2016.01) |
| *F21Y 103/10* | (2016.01) |
| *F21Y 115/10* | (2016.01) |

(52) U.S. Cl.
CPC ..... *F21K 9/90* (2013.01); *F21Y 2103/10* (2016.08); *F21Y 2115/10* (2016.08)

(58) Field of Classification Search
CPC ..... F21Y 2103/10; F21Y 2103/30; F21Y 2103/00; G02B 6/001
See application file for complete search history.

(56) References Cited

U.S. PATENT DOCUMENTS

2009/0141515 A1* 6/2009 Wu et al. ..... G02B 6/001 362/555
2009/0168419 A1* 7/2009 Daimon ..... F21V 5/043 362/235
2010/0011679 A1 1/2010 Monaco et al.
2010/0110679 A1 5/2010 Teng et al.
2011/0038144 A1 2/2011 Chang
2011/0242846 A1* 10/2011 Park ..... G02B 6/003 362/613
2011/0305024 A1 12/2011 Chang
2012/0044675 A1* 2/2012 Buelow ..... G02B 6/001 362/217.05
2012/0155072 A1 6/2012 Chang
2012/0275150 A1* 11/2012 Yokotani et al. ..... F21V 5/043 362/235
2013/0272015 A1* 10/2013 Weaver ..... F21K 9/54 362/555
2013/0308331 A1 11/2013 Ye et al.
2014/0104867 A1* 4/2014 Meng ..... F21K 9/61 362/555

FOREIGN PATENT DOCUMENTS

| | | | |
|---|---|---|---|
| DE | 10 2011 106252 | A1 | 1/2013 |
| EP | 1 621 918 | A1 | 2/2006 |
| EP | 1 813 857 | A1 | 8/2007 |
| EP | 2 208 922 | A1 | 7/2010 |
| JP | H11232912 | A | 8/1999 |
| JP | 2009070817 | A | 4/2009 |
| JP | 2012252988 | A | 12/2012 |
| WO | 2011086104 | A1 | 7/2011 |
| WO | 2013083758 | A1 | 6/2013 |

* cited by examiner

LIGHTING MEANS HAVING A SPECIFIABLE EMISSION CHARACTERISTIC AND PRODUCTION METHOD FOR AN OPTICAL ELEMENT

Documents EP 1621918 B1, WO 2011/086104 A1, US 2011/0305024 A1, US 2011/0038144 A1 and US 2012/0155072 A1 each describe light sources.

One object to be achieved consists in providing a light source which is compact and simple to produce. A further object to be achieved consists in providing a method for producing an optical body which is contained in a light source which is compact and simple to produce.

A light source is provided. The light source may in particular be provided for area lighting. The light source may for example be a screen backlighting system. Moreover, the light source may be provided for general lighting. The light source is then provided for example as room lighting, a ceiling luminaire, lighting for open plan offices, backlighting for a light box for outdoor advertising, corridor lighting, lighting for aircraft cabins or a street lamp.

According to at least one embodiment of the light source, the latter comprises a single optical body with a radiation entrance face and a radiation exit face. The radiation entrance face and the radiation exit face are formed by regions of the outer face of the optical body, wherein these regions may also overlap in places.

The optical body may for example be an in particular cylindrical or semi-cylindrical rod. The optical body may for example consist of a material which is radiation-transmissive and has a higher refractive index than air. For example, the optical body may contain or be formed of glass or an optical plastics material. The optical plastics material may for example be polymethyl methacrylate (also known as acrylic glass), polystyrene, cyclo olefin copolymers or polycarbonate. The refractive index of the material of the optical body may lie for example in a range from at least 1.4 to at most 2.7. The optical body takes the form in particular of a solid body and, within the bounds of manufacturing tolerances, is free of cavities and gas inclusions. The optical body may for example be formed entirely of the same material.

According to at least one embodiment of the light source, the optical body has a main direction of extension. In other words, the spatial extent of the optical body in one spatial dimension is considerably greater than the spatial extent of the optical body in the other two spatial dimensions. For example, the optical body has a length along the main direction of extension and a maximum radial extent in a first plane extending perpendicular to the main direction of extension of the optical body, wherein the maximum radial extent is distinctly smaller than the length. The main direction of extension may for example be the longitudinal axis of a cylinder, semi-cylinder or cuboid.

According to at least one embodiment of the light source, the latter comprises at least two light-emitting diodes, which each comprise at least one light-emitting diode chip and one radiation passage face. In this case, the radiation passage faces of the light-emitting diodes face the radiation entrance face of the optical body, whereby the light emitted by the light-emitting diodes is incoupled directly into the optical body. The light-emitting diode chips emit for example colored light, for instance light in the blue region of the electromagnetic spectrum. In addition, the light-emitting diodes comprise a luminescent material for wavelength conversion. It is accordingly possible to use the light source to generate white light of a predeterminable color temperature.

The radiation passage faces of the at least two light-emitting diodes extend along a main plane of extension. The main direction of extension of the optical body may for example run parallel to the main plane of extension of the light-emitting diode chips.

According to at least one embodiment of the light source, the at least two light-emitting diodes are arranged along the main direction of extension of the optical body. Within the bounds of manufacturing tolerances, the light-emitting diodes are preferably arranged centered relative to the optical body.

Furthermore, the light-emitting diodes may be mounted on a rigid or flexible carrier, such as a printed circuit board with connection points, or another carrier with conductor strips. The carrier may comprise a material which reflects the light emitted by the light-emitting diode. It is however also possible for the light-emitting diodes not to be arranged on a carrier, but rather to be mounted for example on the radiation entrance face of the optical body. The optical body then forms the carrier for the light-emitting diode chips.

According to at least one embodiment of the light source, the radiation entrance face of the optical body extends flat or is convexly curved. Convexly curved means here and hereinafter that the curvature extends outwards, i.e. away from the center of the optical body. A concavely curved radiation entrance face would then therefore be inwardly curved. For example, the radiation entrance face may form a semicircle in a cross-section of the optical body of the first plane, or within the bounds of manufacturing tolerances have no curvature.

According to at least one embodiment of the light source, the radiation exit face of the optical body comprises at least one depression in the optical body. The depression may for example be a recess or notch. The depression is thus directed inwards. The depression may for example be produced by material removal or by way of impression.

The at least one depression is provided to outcouple light propagating in the optical body out of the optical body in the desired manner. Sometimes, homogeneous illumination may be achieved by the depressions. In other words, the depressions have the effect of homogenizing the light distribution curve of the light emitted by the light-emitting diode chips. In particular, the depression may be configured such that the probability of total reflection and/or back reflection at the boundary surface of the propagating light which is outcoupled through a side or outer face of the optical body defining the depression, is either reduced or increased in the desired manner. In other words, the depression is shaped such that the light propagating in the optical body is either preferably outcoupled through the side or outer faces defining the depressions or preferably no light passes through the sides or outer faces. It is accordingly possible, with the depression, to increase the outcoupling efficiency of light incoupled into the optical body and propagating there by way of light wave conduction and/or to generate a desired emission pattern, i.e. a desired intensity distribution, for the light emitted by the light source.

It is moreover possible for the radiation exit face of the optical body to be curved. For example, at least 80%, preferably at least 90%, of the radiation exit face is convexly curved. In particular, it is possible for the radiation exit face of the optical body to be completely convexly curved, apart from the depressions.

According to at least one embodiment of the light source, the latter comprises a single optical body, which has a main direction of extension, a radiation entrance face and a radiation exit face, and at least two light-emitting diodes, which each comprise at least one light-emitting diode chip and a radiation passage face, which extends along a main plane of extension, wherein the at least two light-emitting diodes are arranged along the main direction of extension of the optical body, the radiation entrance face of the optical body faces the radiation passage faces of the light-emitting diodes, the optical body takes the form of a solid body, the radiation entrance face of the optical body extends flat or is convexly curved and the radiation exit face of the optical body comprises at least one depression in the optical body.

With the light source described here, in particular the concept is followed of obtaining a desired emission pattern, in particular a clear forward emission pattern, and high light efficiency through depressions applied to the radiation exit face of the optical body. The optical body contained in the light source may additionally be simply and inexpensively produced, whereby a high flexibility may be achieved with regard to the possible applications of the light source.

According to at least one embodiment of the light source, the at least one depression extends over virtually the entire length, i.e. at least over 90% of the entire length, or over the entire length of the optical body along the main direction of extension. The depression may for example extend, in plan view onto the optical body, along the main direction of extension of the optical body, wherein the depression may extend axially symmetrically relative to a line which runs parallel to the main direction of extension. The at least one depression may be the sole depression in the optical body. In particular it is possible for the light source to comprise just a single depression, which extends over virtually the entire length. In particular, an imaginary line through a point of the single depression and a point on a radiation passage face of a light-emitting diode may form an axis of symmetry for the optical body.

In this embodiment in particular of the light source, between the radiation passage faces of the at least two light-emitting diodes and the radiation entrance face of the optical body is a material with a lower refractive index than the material of the optical body and the material of the at least two light-emitting diodes. The material may in particular also be a gas, such as for example air. In the latter case, a gas-filled gap is thus present between the radiation passage faces of the light-emitting diodes and the radiation entrance face of the optical body. The refraction brought about by this arrangement at the two boundary faces at the transition from the radiation passage faces of the light-emitting diodes to the optical body leads in particular to the radiation profile of the light entering the optical body widening in the plane parallel to the main direction of extension of the optical body and perpendicular to the first plane and narrowing in the second plane. In particular, a substantially Lambertian radiation profile of the light-emitting diode chips may be modified in this way on entry of the radiation into the optical body.

According to at least one embodiment of the light source, the latter comprises at least two depressions, wherein the at least two depressions are arranged along the main direction of extension of the optical body and the at least two depressions extend parallel to the first plane, within the bounds of manufacturing tolerances. In a plan view onto the optical body from above, the depressions extend in this exemplary embodiment in each case parallel to a crossline, which extends transversely of or perpendicular to the longitudinal axis of the optical body. The at least two depressions may for example extend over the entire radiation exit face of the optical body, but it is also possible for the at least two depressions to extend only over part of the radiation exit face of the optical body.

In this embodiment in particular of the light source, between the radiation passage faces of the at least two light-emitting diodes and the radiation entrance face of the optical body there is situated a material with a higher refractive index than or a refractive index identical to the material of the optical body and a lower refractive index than the material of the at least two light-emitting diodes. The material may for example be a bonding silicone layer and/or another adhesive layer. The material may in particular be in direct contact with the radiation passage faces and the radiation entrance face. It is in particular possible for the material to be formed from the same material as the optical body. An aim of this embodiment may for example be refractive index adaptation between the radiation passage faces of the at least two light-emitting diodes and the radiation entrance face of the optical body. In particular, it is possible for the light to undergo just one jump in refractive index on transition from the radiation passage faces of the light-emitting diodes to the optical body.

According to at least one embodiment of the light source, the at least one depression is defined by an outer face which forms part of the outer face of the optical body, and the outer face takes the form of a segment of a circle in a cross-section of the at least one depression, within the bounds of manufacturing tolerances. The shape of the depression or of the outer face of the depression may accordingly be completed to form a circle. The cross-section may for example be parallel to the first plane, i.e. perpendicular to the main axis of extension of the optical body.

According to at least one embodiment of the light source, the at least two depressions are each defined by two side faces, which form part of the outer face of the optical body. The two side faces are arranged relative to one another in such a way that, in a cross-section of the at least one depression, they define the apex or an in particular equilateral triangle within the bounds of manufacturing tolerances. The boundary lines of the two side faces, together with a line connecting the two boundary lines, thus form a triangle. The cross-section is taken for example parallel to a second plane, which is defined by a parallel to the main plane of extension and an axis which runs perpendicular to the main plane of extension of the light-emitting diodes. A cross-section parallel to the second plane then corresponds for example to a section along the main plane of extension of the optical body.

According to at least one embodiment of the light source, the two side faces form an angle at the apex of the triangle of at least 80° and at most 110°. The boundary lines of the two side faces thus form an angle of at least 35° and at most 50° with a line connecting the boundary lines. The emission pattern of the light emitted by the light source here depends heavily on the size of the angle between the two side faces. For example, the angles are adapted to the refractive index of the material of the optical body. Thus, if the refractive index is relatively large, a larger angle is for example needed to obtain the same or similar emission pattern than with a smaller refractive index.

The first depression of the at least two depressions preferably has the same shape or the same cross-section as the second depression of the light source. In the case of a plurality of depressions, these may for example be arranged periodically along the main direction of extension of the radiation exit face of the light source. In other words, the depressions are spaced regularly from one another along the main direction of extension of the optical body.

According to at least one embodiment of the light source, the optical body is the sole optical element of the light source. This means in particular that no further optical element, such as for example a lens, a potting body with scattering particles or the like, is present in the light source. The desired emission pattern of the emitted light is thus achieved solely by the one optical body.

According to at least one embodiment of the light source, the spatial extent of the at least one depression along at least two mutually perpendicular axes amounts to at most 10%, preferably at most 6%, of the spatial extent of the optical body along the same axes. The spatial extent along the two mutually perpendicular axes may furthermore amount to at least 2%, preferably at least 4%, of the spatial extent of the optical body along the same axes. In particular, the two axes may mean the two axes which are perpendicular to the direction of extension of the depression. For example, the maximum extent of the at least one depression corresponds to at most 10%, preferably at most 6%, of the maximum radial extent of the optical body.

For example, the depression has a typical size in the range of at least 20 μm and at most 500 μm. The typical size may here be the spatial extent of the at least one depression along the at least two mutually perpendicular axes. In comparison, the size of the optical body along the axes perpendicular to the main plane of extension lies in a range from 2 mm to 8 mm, while along the main axis of extension it is over 10 mm.

According to at least one embodiment of the light source, the optical body takes the form of a right cylinder or a semi-cylinder. The radiation entrance face of the optical body then corresponds either to half of the curved peripheral surface of a cylinder or to the non-curved peripheral surface of a semi-cylinder. The main direction of extension of the optical body then therefore runs parallel to the longitudinal axis of the cylinder. If the optical body takes the form of a semi-cylinder, the straight side of the semi-cylinder extends, within the bounds of manufacturing tolerances, parallel to the main plane of extension of the light-emitting diodes. The diameter of the cylinder or the radius of the semi-cylinder is for example in a range from 2 mm to 8 mm.

According to at least one embodiment of the light source, the intensity distribution in the far field of the light emitted by the light source has, as a function of a polar angle to the surface normal, which extends in the main plane of extension of the light-emitting diodes and is perpendicular to the main direction of extension of the optical body, two local maxima separated from one another by a single local minimum. Measurement of the intensity distribution as a function of the polar angle takes place for example along a circular line, which runs perpendicular to the main direction of extension of the optical body and parallel to the main plane of extension of the light-emitting diodes.

According to at least one embodiment of the light source, the intensity distribution as a function of the polar angle is axially symmetrical, within the bounds of measuring accuracy. This means that, within the bounds of measuring accuracy, the two local maxima have the same intensity. The axis of symmetry may run through the minimum of the intensity distribution.

According to at least one embodiment of the light source, the minimum of the intensity distribution as a function of the polar angle amounts to at most 60% of the intensity of the maxima. This means that the minimum clearly separates the two maxima from one another. In particular, the minimum is not zero, within the bounds of measuring accuracy. This means that the minimum may be clearly differentiated from the background noise of the measuring apparatus. Such an intensity distribution measured as a function of a polar angle then corresponds in one dimension to a "Batwing" intensity distribution.

According to at least one embodiment of the light source, the intensity distribution in the far field of the light emitted by the light source has, as a function of an azimuth angle to the surface normal, which runs parallel to the main direction of extension of the optical body, a plateau within which the intensity varies up and down by at most 5% around a mean which is not zero, within the bounds of measuring accuracy. The intensity distribution as a function of the azimuth angle may for example be measured along a circle line, which runs parallel to the main direction of extension of the optical body. The intensity distribution may thus be measured for example along the longitudinal axis of the (semi-) cylinder.

According to at least one embodiment of the light source, the half-value width of the intensity distribution measured as a function of the azimuth angle corresponds to at least 70%, preferably at least 80%, of the width of the plateau. In other words, the intensity distribution falls steeply to the sides of the plateau. The half-value width is defined here and hereinafter as the full width at half maximum, i.e. the half-value width is provided by the difference between the two angles at which the intensity distribution has fallen in each case to half the average maximum intensity. The width of the plateau is for example provided by the difference between the two angles at which the level of the intensity amounts to less than 5% of the mean thereof.

According to at least one embodiment of the light source, the half-value width of the intensity distribution as a function of the azimuth angle is greater by at least a factor of 1.7, preferably by at least a factor of 2.4, than the half-value width of the intensity distribution as a function of the polar angle. In other words, the light distribution which is emitted by the light source is not radially symmetrical but rather is wider along the main direction of extension of the optical body than it is perpendicular thereto. The intensity distribution thus reflects the shape of the optical body. In particular, the light emitted transversely of the main direction of extension may be collimated and the light emitted along the main direction of extension widened.

According to at least one embodiment of the light source, the intensity distribution as a function of the polar angle is substantially translationally invariant. In other words, the intensity distribution as a function of the polar angle does not vary along the main plane of extension of the light source. For example, measurement of the intensity distribution as a function of the polar angle and of the polar angle may be performed using an "integrating sphere". The integrating sphere may then be applied for measurement of the intensity distribution as a function of the polar angle at any desired point along the main direction of extension of the optical body, the same result always being achieved.

According to at least one embodiment of the light source, the optical body comprises luminescent material particles for wavelength conversion of the electromagnetic radiation emitted by the light-emitting diodes. For example, the light-emitting diodes emit blue light, which is converted into green, white, red and/or red-yellow light by the luminescent material particles. For example, the luminescent material particles may be uniformly distributed in the optical body. It is however also possible for the luminescent material particles only to be present at an outer face of the optical body. It is additionally possible for the luminescent material particles to be contained in a layer applied to an outer face of the optical body. Furthermore, the optical body may also contain other, non-converting scattering particles. The scattering particles may for example contain a metal oxide, such as for example titanium dioxide ($TiO_2$).

A method is also provided for producing an optical body contained in a light source described here. In other words, all the features disclosed for the light source or for the optical body are also disclosed for the method and vice versa.

According to at least one embodiment of the method, the still soft material of the optical body is drawn continuously out of the melt through a shaping orifice. In other words, the optical body is produced by means of extrusion, draw-molding or pultrusion. Such a method in particular enables the production of optical bodies of variable lengths without major modifications to the process.

According to at least one embodiment of the method, the at least one depression is introduced into the not yet wholly solidified optical body. The depression may for example be introduced with a surface-patterned roller or a shaping wheel. In this case, no material is removed from the optical body, but rather material is displaced in the optical body to form the depression.

It is however also possible for the depressions to be removed from the optical body, i.e. for part of the optical body to be removed therefrom.

The light source described here is explained in greater detail below with reference to exemplary embodiments and the associated figures.

Figure 1A:
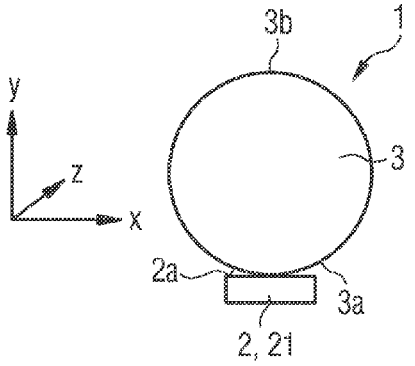
FIG. 1 and FIG. 2 show exemplary embodiments of the light source described here.

Identical, similar or identically acting elements are provided with the same reference numerals in the figures. The figures and the size ratios of the elements illustrated in the figures relative to one another are not to be regarded as being to scale. Rather, individual elements may be illustrated on an exaggeratedly large scale for greater ease of depiction and/or better comprehension.

Figure 1B:
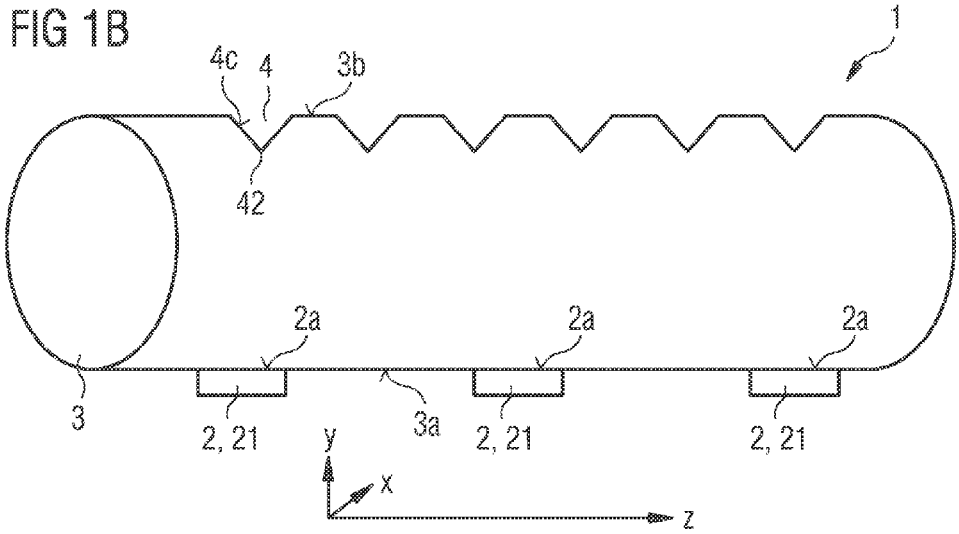

FIG. 1 shows a first exemplary embodiment of a light source 1 described here. FIG. 1A shows the light source 1 by means of a schematic sectional representation parallel to the first plane XY, which is defined by the two axes X, Y situated perpendicular to the main direction of extension Z of the optical body. FIG. 1B shows side view of the light source 1.

As FIG. 1A shows, the light source 1 comprises an optical body 3 with a radiation entrance face 3*a* and a radiation exit face 3*b*, and at least one light-emitting diode 2 which comprises at least one light-emitting diode chip 21 and a radiation passage face 2*a* extending substantially parallel to the main plane of extension XZ of the light emitting diodes 2. The light-emitting diode chips take the form for example of "large-area radiators", i.e. the radiation profile of the light-emitting diode chips is substantially Lambertian. The dimensions along the main plane of extension XZ of a radiation passage face 2*a* of a light-emitting diode 2 lie in the range from at least 0.5 $mm^2$ to at most 1 $mm^2$. The radiation passage face 2*a* of the light-emitting diode 2 may for example be square or rectangular. The choice of dimensions for the optical body 3 is dependent on the choice of dimensions for the radiation passage face 2*a*.

In the exemplary embodiment shown, the cross-section through the optical body 3 along the first plane XY forms a circle. The optical body 3 is thus of cylindrical construction. It is however also possible for the optical body 3 to be of semi-cylindrical construction. The light-emitting diode 2 may for example be in direct contact with the optical body 3, but it is also possible, unlike in FIG. 1A, for a bonding material to be arranged between the light-emitting diodes 2 and the optical body 3.

As may be inferred from the schematic side view of FIG. 1B, the light-emitting diodes are arranged along the main direction of extension Z of the light source 1. The spacing along the main direction of extension Z between two adjacent light-emitting diodes amounts, for example, to 10 mm. The selected spacing is dependent on the desired intensity and homogeneity distribution of the light emitted by the light source 1 and may thus vary.

A plurality of depressions 4 are arranged at the radiation exit face 3*b* of the optical body 3, which depressions extend parallel to the first plane XY, within the bounds of manufacturing tolerances. The depressions 4 are defined by two side faces 4*c*. The side faces 4*c* form part of the outer face 3*a*, 3*b* of the optical body 3. The two side faces 4*c* together form the apex 42 of an equilateral triangle. The two side faces 4*c* form an angle with one another of at least 80° and at most 110°.

In the exemplary embodiment shown in FIG. 1 of a light source 1 described here, the distance between the apex 42 of the triangle formed and the radiation exit face 3*b* lies for example in a range between at least 50 μm and at most 500 μm. The distance to the radiation exit face may for example amount to 200 μm. The distance between adjacent depressions may amount for example to at most 100 μm. This indicates the width of the region on the radiation exit face 3*b* of the optical body 3 which is located between the depressions 4. The distances and dimensions may vary up and down by for example 20% from the values just stated. The distances and dimensions of the triangles formed are dependent on the dimensions of the optical body.

Figure 2A:
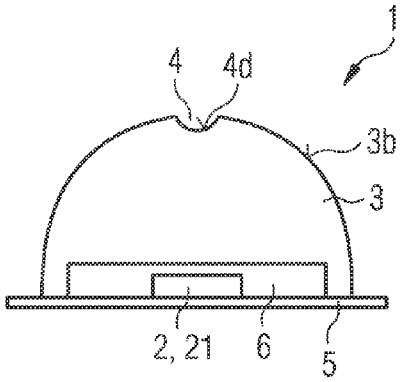
Figure 2B:
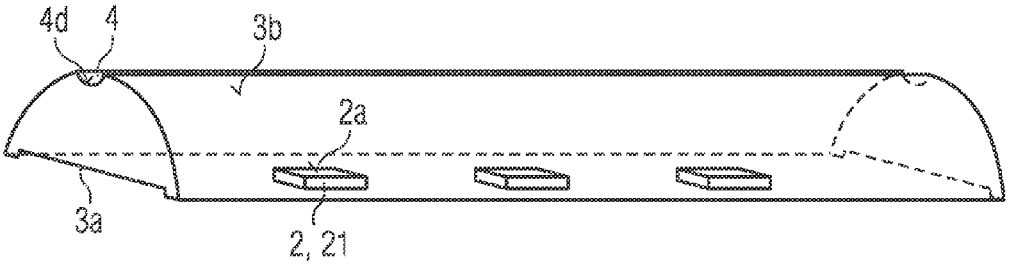

In accordance with the schematic sectional representations of FIG. 2, a further exemplary embodiment of a light source 1 described here is described in greater detail. FIG. 2A shows a sectional representation parallel to the first plane XY and FIG. 2B shows a side view. In the exemplary embodiment shown, the cross-section through the optical body 3 along the first plane XY forms a semi-circle. The optical body 2 thus takes the form of a semi-cylinder. In addition, the depression 4 extends along the main direction of extension Z of the optical body 3. There is only a single depression 4 in the optical body 3.

The light-emitting diodes 2 are arranged on a carrier 5, but it is also possible for outer faces of the light-emitting diodes 2 to be in direct contact with the optical body 3 at least in places, meaning that no carrier 5 is needed. On the top face facing the light-emitting diode 2, the carrier 5 may for example comprise a reflective layer which reflects for example over 90% of the light emitted by the light-emitting diodes 2. An air gap 6 is located between the light-emitting diodes 2 and the optical body 3. The air gap 6 has a lower refractive index than the material of the optical body 3 and the material of the light-emitting diode 2.

The at least one depression is defined by an outer face 4*d*, which forms part of the outer face 3*a*, 3*b* of the optical body 3. Within the bounds of manufacturing tolerances, the outer face 4*d* of the depression 4 takes the form, in cross-section parallel to the first plane XY, of a segment of a circle. The distance from the lowest point of the segment of a circle to the highest point of the radiation exit face 3*b* of the optical body 3 may amount for example to 200 μm and the width of the depression for example to 0.5 mm. The dimensions of the depression may vary up or down by up to 20% from these values just stated.

Figure 3A:
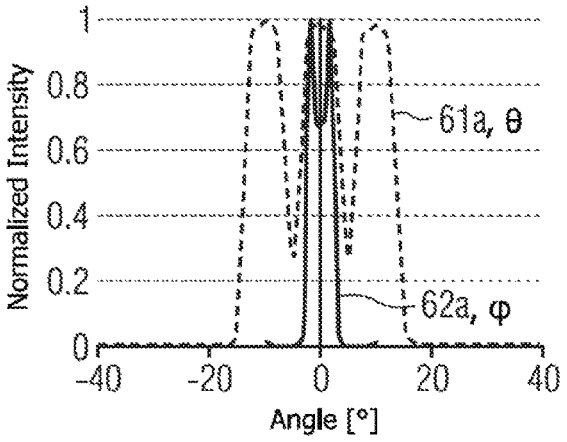
FIGS. 3 to 5 show intensity distributions in the near and far field for the electromagnetic radiation emitted by exemplary embodiments of a light source described here.
Figure 3B:
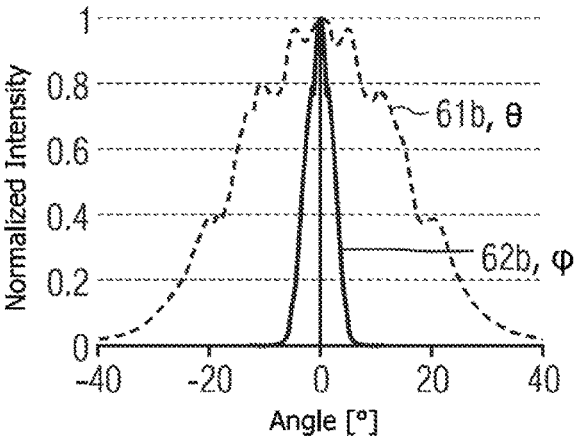
Figure 3C:
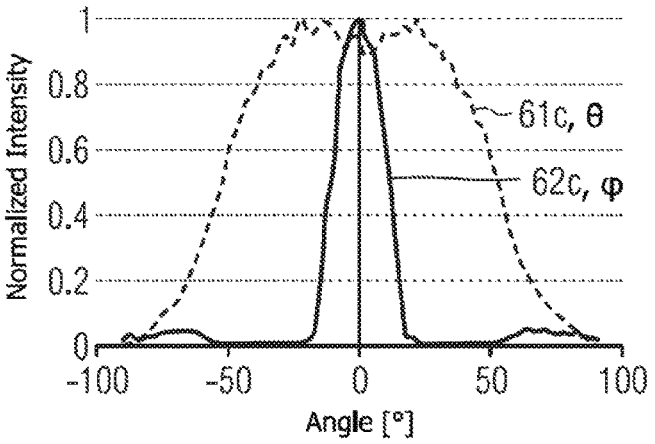
Figure 4A:
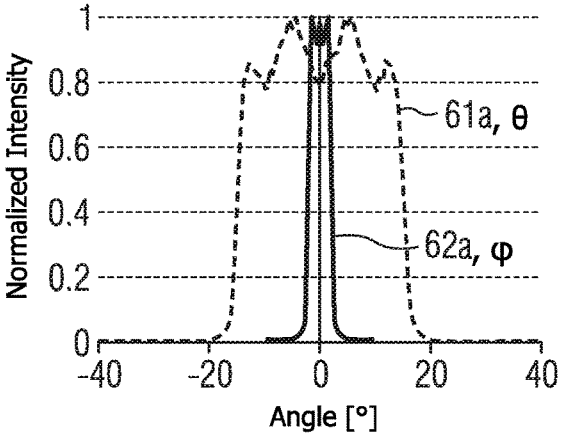
Figure 4B:
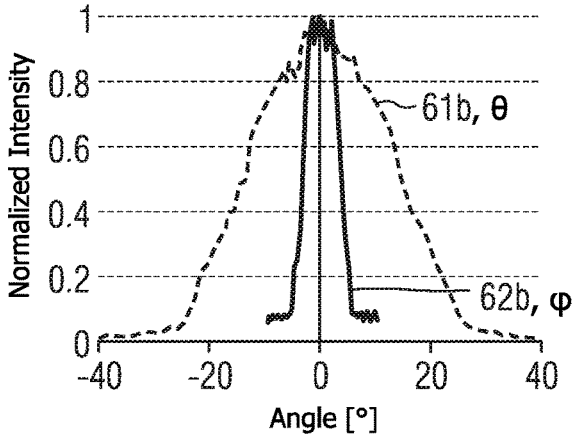
Figure 4C:
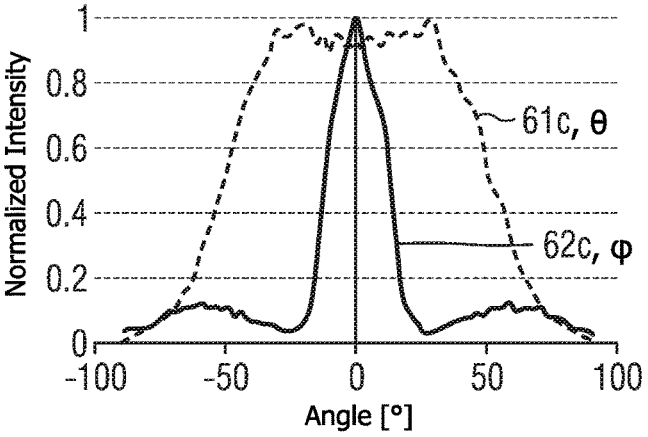
Figure 5A:
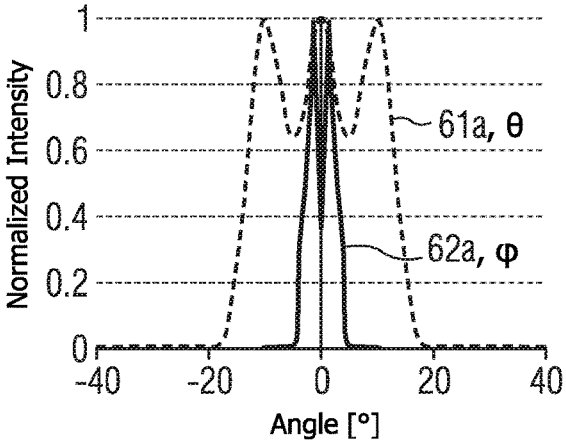
Figure 5B:
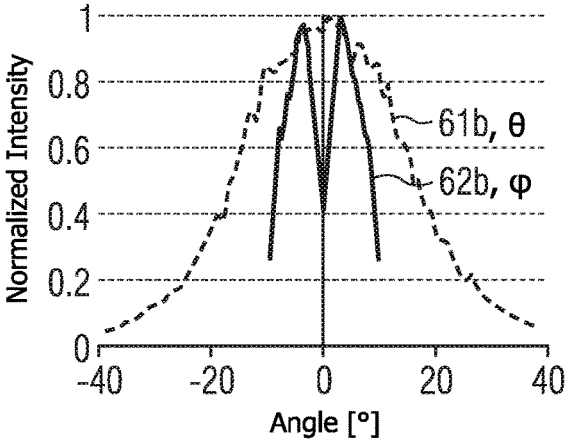
Figure 5C:
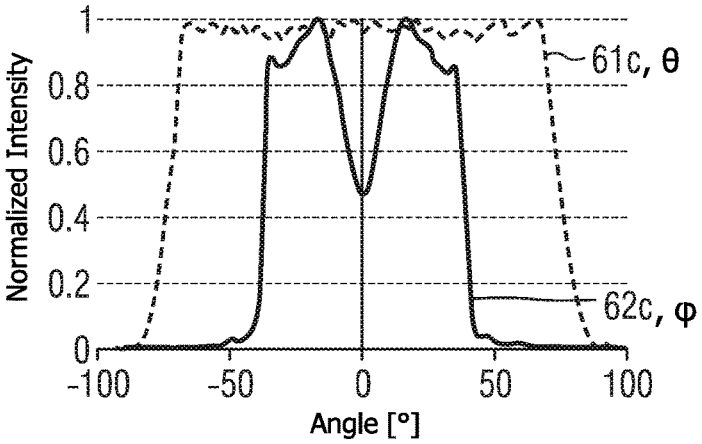

FIGS. 3, 4 and 5 show simulated normalized intensity distributions 61*a*, 61*b*, 61*c*, 62*a*, 62*b*, 62*c* of the light emitted by exemplary embodiments of a light source 1 described here as a function of the azimuth angle θ and of the polar angle φ. FIGS. 3A, 4A and 5A here each show the intensity distributions 61*a*, 62*a* in the near field of the light at a distance of 1 mm above the radiation exit face 3*b* of the optical body 3. FIGS. 3B, 4B and 5B each show the intensity distributions 61*b*, 62*b* in the intermediate field of the light at a distance of 10 mm above the radiation exit face 3*b* of the optical body 3. FIGS. 3C, 4C and 5C each show the intensity distributions 61*b*, 62*b* in the far field of the light. The intensity distributions 61*a*, 61*b*, 61*c*, 62*a*, 62*b*, 62*c* are normalized to their respective maxima.

FIGS. 3A, 3B and 3C show intensity distributions 61*a*, 61*b*, 61*c*, 62*a*, 62*b*, 62*c* of the light emitted by an exemplary embodiment, described in conjunction with FIG. 1, of light source 1 described here, wherein the depressions 4 in the radiation exit face 3*b* of the optical body 3 of the exemplary embodiment are negligibly small. In other words, the depressions 4 cannot be distinguished from a typical surface roughness of the material of the optical body 3. In particular, the intensity distributions in the near field 61*a*, 62*a* exhibit major fluctuations in intensity, which are reduced for the intensity distributions in the far field 61*c*, 62*c*. The intensity distribution in the far field 61*c* as a function of the polar angle φ is in particular relatively narrow. The intensity distribution in the far field 62*c* as a function of the polar angle φ of a light source 1 with an optical body 3 which, within the bounds of manufacturing tolerances, does not comprise any depressions 4, is however not translationally invariant along the main plane of extension Z of the optical body 3 (not shown in the figures).

FIGS. 4A, 4B and 1C show intensity distributions 61*a*, 61*b*, 61*c*, 62*a*, 62*b*, 62*c* of the light emitted by an exemplary embodiment, described in conjunction with FIG. 1, of light source 1 described here, wherein the triangular depressions 4 in the radiation exit face 3*b* of the optical body 3 are now no longer negligibly small. Due to the depressions 4, the fluctuations in the intensity distributions in the near field 61*a*, 62*a* and in the intermediate field 61*b*, 62*b* are reduced markedly in comparison with the distributions of FIGS. 3A and 3B. The intensity distributions in the near field 61*a*, 62*a* and in the intermediate field 61*b*, 62*b* are thus more homogeneous than those of FIGS. 3A and 3B. An optical body 3 with detectable depressions 4 may thus sometimes lead to more rapid homogenization of the light propagating therethrough. The intensity distributions in the far field 61*c*, 62*c* have a similar profile to those of FIG. 3C, but in the case of the detectable depressions 4 illustrated in FIG. 4C more of the light propagating in the optical body 3 is outcoupled out of the optical body 3. In addition, the intensity distribution in the far field 62*c* as a function of the polar angle φ is translationally invariant along the main plane of extension Z of the optical body 3 (not shown in the figures).

Moreover, the intensity distribution in the far field 61*c* as a function of the azimuth angle θ has a plateau, within which the measured intensity varies by at most 5% around a mean which is not zero, within the bounds of measuring accuracy. The width of the plateau amounts to approximately 70°±5°. In comparison, the half-value width of the intensity distribution 61*c* amounts to approximately 100°±5°. The width of the plateau of the intensity distribution 61*c* thus amounts to at most 70% of the half-value width.

FIGS. 5A, 5B and 5C show intensity distributions 61*a*, 61*b*, 61*c*, 62*a*, 62*b*, 62*c* of the light emitted by an exemplary embodiment, described in conjunction with FIG. 2, of a light source 1 described here. Intensity fluctuations may once again be made out in the near field, wherein in particular the fluctuations in the intensity distributions in the near field 62*a* and intermediate field 62*b* as a function of the polar angle φ continue also still to be clearly apparent in the far field 62*c*.

In particular, the intensity distributions 62*a*, 62*b*, 62*c* as a function of the polar angle φ each have two maxima, which are separated by a minimum. Within the bounds of measuring accuracy and manufacturing tolerances, the intensity distributions 62*a*, 62*b*, 62*c* are each axially symmetrical relative to an axis which runs through the minimum. The minimum exhibits at most 60% of the intensity of the respective maximum, wherein the minimum is not zero. Such an intensity distribution is particularly suitable for illuminating corridors or streets.

The intensity distribution in the far field 61*c* as a function of the azimuth angle θ shown in FIG. 5C likewise exhibits a plateau. The width of the plateau amounts to approximately 140°±5°. In comparison, the half-value width of the intensity distribution 61*c* amounts to approximately 150°±5°. The width of the plateau of the intensity distribution 61*c* thus amounts to at most 80% of the half-value width.

The intensity distributions 61*a*, 62*b*, 61*c* as a function of the azimuth angle θ shown in FIGS. 3, 4 and 5 are always wider than the intensity distributions 62*a*, 62*b*, 62*c* as a function of the polar angle φ. The reason for this is that the optical body 3 has a main direction of extension Z. In other words, the intensity distributions 61*a*, 61*b*, 61*c*, 62*a*, 62*b*, 62*c* of the light source 1 represent the shape of the optical body 3.

The light source 1 described here is inexpensive and very flexible with regard to use due to the need for just one optical body 3 which is simple to produce. Due to the depressions 4 applied to the radiation exit face 3*b*, increased optical efficiency may be achieved and the emission pattern of the light source 1 adjusted. The spacing and the dimensions or the geometry of the depression 4 are here adapted to the dimensions of the optical body 3 in order to obtain a desired emission pattern.

Optical efficiency is here a statement of the percentage of light intensity emitted by the light source relative to the light intensity incoupled into the optical body. The optical efficiency of an optical body with depressions amounts for example to 96.7% and the optical efficiency of an optical body without depressions to 81.5%. The optical efficiency of an optical body with depressions may in particular amount to 98%.

The present application claims priority from German patent application 10 2014 100 582.1, the disclosure content of which is hereby included by reference.

The description made with reference to exemplary embodiments does not restrict the invention to these embodiments. Rather, the invention encompasses any novel feature and any combination of features, including in particular any combination of features in the claims, even if this feature or this combination is not itself explicitly indicated in the claims or exemplary embodiments.

The invention claimed is:

1. A light source comprising:

an optical body having a main direction of extension, a radiation entrance face, and a radiation exit face; and at least two light-emitting diodes, each comprising at least one light-emitting diode chip, and a radiation passage face, which extends along a main plane of extension, wherein the at least two light-emitting diodes are arranged along the main direction of extension of the optical body, wherein the radiation entrance face of the optical body faces the radiation passage faces of the at least two light-emitting diodes, wherein the optical body takes the form of a solid body, wherein the radiation entrance face of the optical body extends flat or is convexly curved, wherein the radiation exit face of the optical body comprises at least one depression in the optical body, and wherein an intensity distribution in the far field of the light emitted by the light source has, as a function of a polar angle to the surface normal, which extends in the main plane of extension and is situated perpendicular to the main direction of extension of the optical body, two local maxima separated from one another by a single local minimum, and wherein the minimum amounts to at most 60% of the intensity of the maxima.

2. The light source according to claim 1, wherein the at least one depression extends over the entire length of the optical body along the main direction of extension, wherein the at least one depression is defined by an outer face, which forms part of the outer face of the optical body, wherein the outer face takes the form of a segment of a circle in a cross-section of the at least one depression, and wherein the spatial extent of the at least one depression along at least two mutually perpendicular axes amounts to at most 10% of the spatial extent of the optical body along the same axes.

3. The light source according to claim 2, wherein between the radiation passage faces of the at least two light-emitting diodes and the radiation entrance face of the optical body there is situated a material with a lower refractive index than the material of the optical body and the material of the at least two light-emitting diodes.

4. The light source according to claim 1, wherein the optical body comprises at least two depressions, wherein the at least two depressions are arranged along the main direction of extension of the optical body and the at least two depressions extend parallel to a first plane which is defined by two axes situated perpendicular to the main direction of extension of the optical body, and wherein the optical body takes the form of a right cylinder or a semi-cylinder, wherein, in the case of the semi-cylinder, the radiation entrance face is the non-curved peripheral surface of the semi-cylinder.

5. The light source according to claim 1, wherein the at least one depression extends over the entire length of the optical body along the main direction of extension.

6. The light source according to claim 5, wherein single depression is present.

7. The light source according to claim 4, wherein between the radiation passage faces of the at least two light-emitting diodes and the radiation entrance face of the optical body there is situated a material with a higher refractive index than or a refractive index identical to the material of the optical body and a lower refractive index than the material of the at least two light-emitting diodes.

8. The light source according to claim 1, comprising at least two depressions, wherein the at least two depressions are arranged along the main direction of extension of the optical body, and wherein the at least two depressions extend parallel to a first plane which is defined by two axes situated perpendicular to the main direction of extension of the optical body.

9. The light source according to claim 8, wherein at least one of the at least two depressions is defined by two side faces which form part of the outer face of the optical body, wherein the two side faces are arranged relative to one another in such a way that, in a cross-section of the at least one depression, they define the apex of an in particular equilateral triangle, and wherein the two side faces form an angle of at least 80° and at most 100° at the apex of the triangle.

10. The light source according to claim 1, wherein the optical body is the sole optical element of the light source.

11. The light source according to claim 1, wherein the spatial extent of the at least one depression along at least two mutually perpendicular axes amounts to at most 10% of the spatial extent of the optical body along the same axes.

12. The light source according to claim 11, wherein the spatial extent of the at least one depression along at least two mutually perpendicular axes amounts to at least 2% of the spatial extent of the optical body along the same axes.

13. The light source according to claim 1, wherein the optical body takes the form of a right cylinder or a semi-cylinder.

14. The light source according to claim 1, wherein the intensity distribution is axially symmetrical.

15. The light source according to claim 1, wherein the intensity distribution in the far field of the light emitted by the light source has, as a function of an azimuth angle to the surface normal, which runs parallel to the main direction of extension of the optical body, a plateau within which the intensity varies up and down by at most 5% around a mean which is not zero, wherein the half-value width of the intensity distribution corresponds to at least 70% of the width of the plateau and wherein the half-value width of the intensity distribution as a function of the azimuth angle is greater by at least a factor of 1.7, preferably by at least a factor of 2.4, than the half-value width of the intensity distribution as a function of the polar angle.

16. The light source according to claim 1, wherein the intensity distribution in the far field of the light emitted by the light source as a function of the polar angle is translationally invariant along the main plane of extension.

17. The light source according to claim 1, wherein the optical body contains luminescent material particles for wavelength conversion of the electromagnetic radiation emitted by the light-emitting diodes.

18. A method for producing an optical body for a light source according to claim 1, comprising the following steps:

draw-molding the optical body from the melt; and introducing the at least one depression into the not yet fully cooled optical body.

* * * * *